US006817288B2

(12) United States Patent
Flatt

(10) Patent No.: US 6,817,288 B2
(45) Date of Patent: Nov. 16, 2004

(54) SCREEN-PRINTING APPARATUS WITH PNEUMATIC SCREEN FRAME CLAMPS

(76) Inventor: Jerry L. Flatt, 3526 Bartlett Dr., Cookeville, TN (US) 38506-7409

( * ) Notice: Subject to any disclaimer, the term of this patent is extended or adjusted under 35 U.S.C. 154(b) by 0 days.

(21) Appl. No.: 10/685,408

(22) Filed: Oct. 16, 2003

(65) Prior Publication Data

US 2004/0089169 A1 May 13, 2004

Related U.S. Application Data

(60) Provisional application No. 60/425,745, filed on Nov. 13, 2002.

(51) Int. Cl.[7] ..... B05C 17/06; B05C 17/08; B41L 13/00

(52) U.S. Cl. ..... 101/126; 101/114; 101/128.1; 101/127.1; 101/123; 101/474

(58) Field of Search ..... 101/114–115, 126–127.1, 101/123, 474, 128.1–128.4

(56) References Cited

U.S. PATENT DOCUMENTS

| | | | | |
|---|---|---|---|---|
| 4,022,156 A | | 5/1977 | Esterline | |
| 4,079,671 A | | 3/1978 | Dubuit | |
| 4,215,262 A | * | 7/1980 | Brastow | 219/95 |
| 4,442,772 A | | 4/1984 | Bubley | |
| 4,696,228 A | | 9/1987 | David et al. | |
| 4,771,687 A | | 9/1988 | Daunheimer | |
| 4,809,604 A | | 3/1989 | Harpold | |
| 4,829,894 A | | 5/1989 | Gardner | |
| 4,974,508 A | | 12/1990 | Anderson et al. | |
| 5,197,388 A | | 3/1993 | Keast et al. | |
| 5,235,908 A | | 8/1993 | Froelicher et al. | |
| 5,309,831 A | | 5/1994 | Fuqua et al. | |
| 5,454,307 A | | 10/1995 | Chen | |
| 5,740,732 A | | 4/1998 | Karlyn et al. | |
| 5,913,263 A | | 6/1999 | Hruska | |
| 2002/0078754 A1 | * | 6/2002 | Chen | 73/715 |

* cited by examiner

*Primary Examiner*—Andrew H. Hirshfeld
*Assistant Examiner*—Marissa Ferguson
(74) *Attorney, Agent, or Firm*—Richard C. Litman

(57) ABSTRACT

A screen-printing apparatus having pneumatically operated clamping devices for clamping one edge of a print screen frame to the print head of the apparatus. In a screen-printing operation where multiple print screens must be quickly interchanged, efficiency of time and energy may be achieved by a manually activated pneumatic clamping device that quickly secures and releases one edge of the screen frame to the print head. The screen-printing apparatus is not limited to a single print head, and multiple pneumatic clamping devices are envisioned for as many screen print heads as are mounted on the screen-printing apparatus.

8 Claims, 5 Drawing Sheets

SCREEN-PRINTING APPARATUS WITH PNEUMATIC SCREEN FRAME CLAMPS

CROSS-REFERENCE TO RELATED APPLICATION

This application claims the benefit of U.S. Provisional Patent Application Ser. No. 60/425,745, filed Nov. 13, 2002.

BACKGROUND OF THE INVENTION

1. Field of the Invention

The present invention relates to screen-printing apparatus and, more specifically, to a screen-printing apparatus having pneumatically operated clamping devices for holding the edge of a rigid frame of a printing screen in order to permit faster and easier replacements of print screens.

2. Description of Related Art

Various types of manually operated screen-printing apparatus are known in the prior art. One commonly used type of construction is known as the Harco screen-printing machine made by Brown Manufacturing Company, as described in U.S. Pat. No. 4,809,604, issued to Harpold on Mar. 7, 1989, which is incorporated herein by reference.

The Harco machine typically includes four separate head units, each head unit being capable of holding one print screen by clamping onto an edge of the rigid frame surrounding the screen that contains the indicia. Each of the four heads is mounted onto a carousel that can be rotated to align any one of the four print screens with a textile article, such as a T-shirt or jersey, placed on a platen. Ink is then applied to the surface of the screen, passing through the unmasked portion of the screen to the exposed and aligned surface of the textile article. In addition to the typical four-head apparatus, similar manually operated apparatus have been equipped with one, two or six heads as well. In this and other similar devices, the print screens are generally clamped in place along an edge of the screen frame by hand using threaded knobs. Mounting and remounting of screens is time-consuming and labor-intensive, especially when multiple print screens having different indicia are required.

Improvements in screen-printing apparatus are known in the relevant art. Pneumatic or hydraulic devices for raising and lowering the print screen, for positioning the workpiece, and for stretching the screen on a frame are a few of the improvements disclosed in the related art.

U.S. Pat. No. 4,022,156, issued to Esterline on May 10, 1977, teaches a hydraulically operated work holder in which the device opens or closes a frame. U.S. Pat. No. 4,079,671, issued to Dubuit on Mar. 21, 1978, teaches a screen-printing machine for printing onto an article placed on a cylindrical support using a hydraulically or pneumatically actuated squeegee.

U.S. Pat. No. 4,442,772, issued to Bubley on Apr. 17, 1984, teaches a screen tensioning apparatus using a pneumatic tensioning device. U.S. Pat. No. 4,696,228, issued to David et al. on Sep. 29, 1987, describes a cantilevered support frame to hold a screen that includes a pneumatically actuated bladder.

U.S. Pat. No. 4,771,687, issued to Daunheimer on Sep. 20, 1988, teaches a pneumatically operated screen-printing apparatus for printing nonplanar workpieces in which the pneumatic device moves the screen into place on the workpiece. U.S. Pat. No. 4,829,894, issued to Gardner on May 16, 1989, teaches a balloon printing machine having a pneumatically operated squeegee.

U.S. Pat. No. 4,974,508, issued to Anderson et al. on Dec. 4, 1990, teaches a four-head manually operated screen-printing apparatus. U.S. Pat. No. 5,197,388, issued to Keast et al. on Mar. 30, 1993, teaches a clamping apparatus for use in the screen of curved articles wherein the curved workpiece is held in place by a spring biased clamp.

U.S. Pat. No. 5,235,908, issued to Froelicher et al. on Aug. 17, 1993, teaches a screen fabric stretching apparatus having pneumatic stretching components. U.S. Pat. No. 5,309,831, issued to Fuqua et al. on May 10, 1994, teaches a rotatable multicolor screen-printing apparatus having a powered squeegee device.

U.S. Pat. No. 5,454,307, issued to Chen on Oct. 3, 1995, teaches an apparatus for screen-printing shoe soles including pneumatically actuated clamping members. U.S. Pat. No. 5,740,732, issued to Karlyn et al. on Apr. 21, 1998, teaches an apparatus for simultaneously manufacturing a plurality of annularly shaped screen frames.

U.S. Pat. No. 5,913,263, issued to Hruska on Jun. 22, 1999, teaches a device using pneumatic devices to stretch printing screens.

None of the above inventions and patents, taken either singly or in combination, is seen to describe a manually operated screen-printing apparatus having a pneumatic clamping device for quickly and easily holding or releasing a printing screen as claimed.

SUMMARY OF THE INVENTION

The present invention is a screen-printing apparatus in which print screens are held in place by a pneumatically actuated clamping device. The screen-printing apparatus may includes at least one screen-holding head, each head having clamped to it an edge of a print screen frame. The apparatus uses switch actuated pneumatic cylinders to cooperatively engage or disengage clamps holding an edge of a print screen frame to the screen-printing apparatus.

When a complete set of jerseys for use by an entire sports team, e.g., for hockey or football, is produced, multiple screens having a variety of indicia are needed, necessitating frequent changing of the print screen during production. The screen=printing apparatus of the present invention reduces the time needed to interchange the print screens during production.

Accordingly, it is a principal object of the invention to provide a screen-printing apparatus in which an edge of a print screen is held in place by a pneumatically operated clamping device.

It is another object of the invention provide an apparatus including a plurality of print screen holding heads mounted on a carousel, each print head having pneumatic clamping devices.

It is a further object of the invention to provide an air distribution system that is centrally mounted within a carousel supporting a plurality of print screen holding heads, thereby allowing the carousel to rotate freely about the air supply without entangling the air supply tubes supplying each clamping device.

Still another object of the invention is to provide a screen-printing apparatus in which each print screen holding head includes a pair of pneumatic cylinders operated in tandem.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is a manual screen-printing apparatus which is modified to include pneumatic cylinders that are manually actuated to engage or disengage clamps that hold an edge of the frame of a respective print screen.

Figure 1:
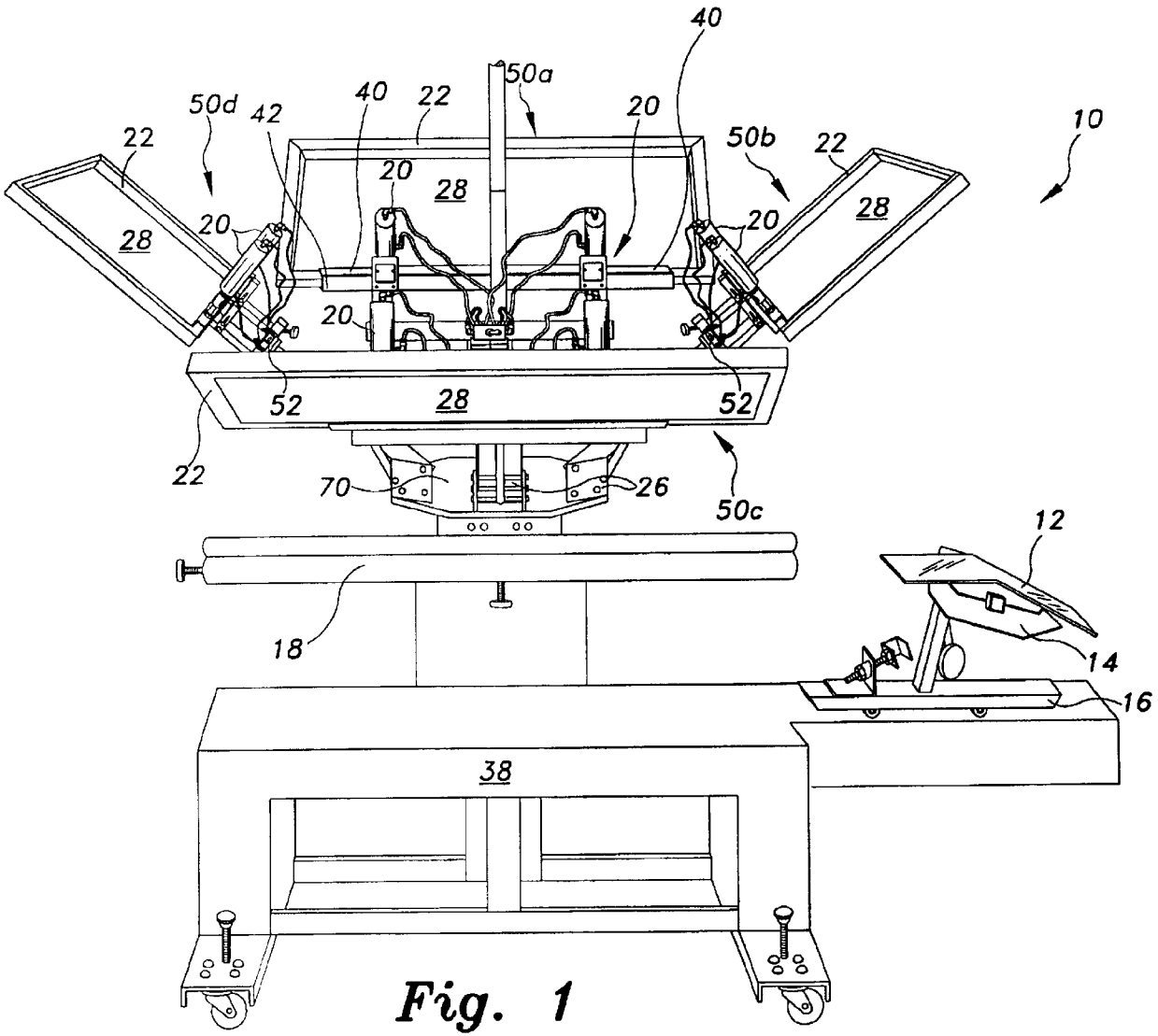
FIG. 1 is a perspective view of a four-head screen-printing apparatus having pneumatic screen frame clamps according to the invention.

FIG. 1 shows a four-head manual screen-printing apparatus, designated generally in the drawings as 10, having dual cylinders 20 mounted to each of the four print heads 50*a*, 50*b*, 50*c* and 50*d*. Although the present modification is shown applied to a screen-printing apparatus having four heads, the modification may be similarly applied to a screen-printing apparatus having any number of print heads. An individual printing screen 28 is removably attached to each head 50*a*, 50*b*, 50*c* and 50*d* by means of a two-part clamping device that that cooperatively engages an edge of a screen-printing frame 22. The screen-printing frame 22 encloses a screen 28 that is masked to print the desired indicia. Typical indicia include letters and numbers for use in sports-related wearable fabric articles, in which the height of the indicia vary in size from two inches, e.g., for use on the shoulder portion of the fabric article, to twelve inches for the backs of jerseys.

Each head 50*a*, 50*b*, 50*c* and 50*d* includes two pneumatic cylinders 20 that operate in tandem to cooperatively engage the edge of screen frame 22 between a movable portion 40 of the two-part clamp and a stationary portion 42 of the clamp. A two-position valve 52 operates the tandem cylinders 20 to either open the clamp or close the clamp, that is, by reciprocating movement of the movable portion 40 of the clamp toward, or away from, the stationary portion 42 of the clamp.

A textile or fabric workpiece, such as a T-shirt or jersey, which receives the indicia during the screen-printing operation, is initially placed onto a support platen 12. The support platen 12 may be illuminated from below by a light source 14, e.g., by a fluorescent lamp. The platen 12 may itself be mounted onto a support 16 that is movable linearly along the surface of the main body 38 of the screen-printing apparatus 10. A linear scale on a bar 18 may be provided to assist in aligning the movable platen 12 to the appropriate position on the surface of main body 38 to accurately receive the indicia.

During the screen-printing operation, the platen 12 with the textile workpiece placed thereon is first fixed in position. Second, the carousel 70 holding the four heads 50*a*, 50*b*, 50*c* and 50*d*, with each head 50*a*, 50*b*, 50*c* and 50*d* having a print screen frame 22 and screen 28 clamped thereon, is rotated, to move the appropriate screen 28 in place above the textile workpiece. Third, the print screen 28 is lowered by pivoting the head 50*a*, 50*b*, 50*c* or 50*d* on its arm 26 until the underside of the screen 28 contacts the exposed surface of the workpiece and is held in this position while screen-printing ink is applied onto the top surface of the screen 28, and a squeegee (not shown) is then used to evenly distribute the printing ink over and through the screen 28 onto the textile workpiece.

After applying the indicia to the workpiece, the head 50*a*, 50*b*, 50*c* or 50*d* and the attached screen frame 22 is then raised to release the textile workpiece. At this point the operator may rotate the carousel 70 to present another print head 50*a*, 50*b*, 50*c* or 50*d* to the workpiece, interchange print screens 28 into the same print head 50*a*, 50*b*, 50*c* or 50*d*, or apply the indicia to another workpiece. If no further indicia are required on this workpiece, the textile workpiece is removed from the platen 12 and placed into an oven to bake, thereby fixing the indicia in place on the surface of the textile workpiece. An optional flash heater (not shown) can be used to accelerate setting of the indicia ink composition during the process of screen-printing.

Figure 2:
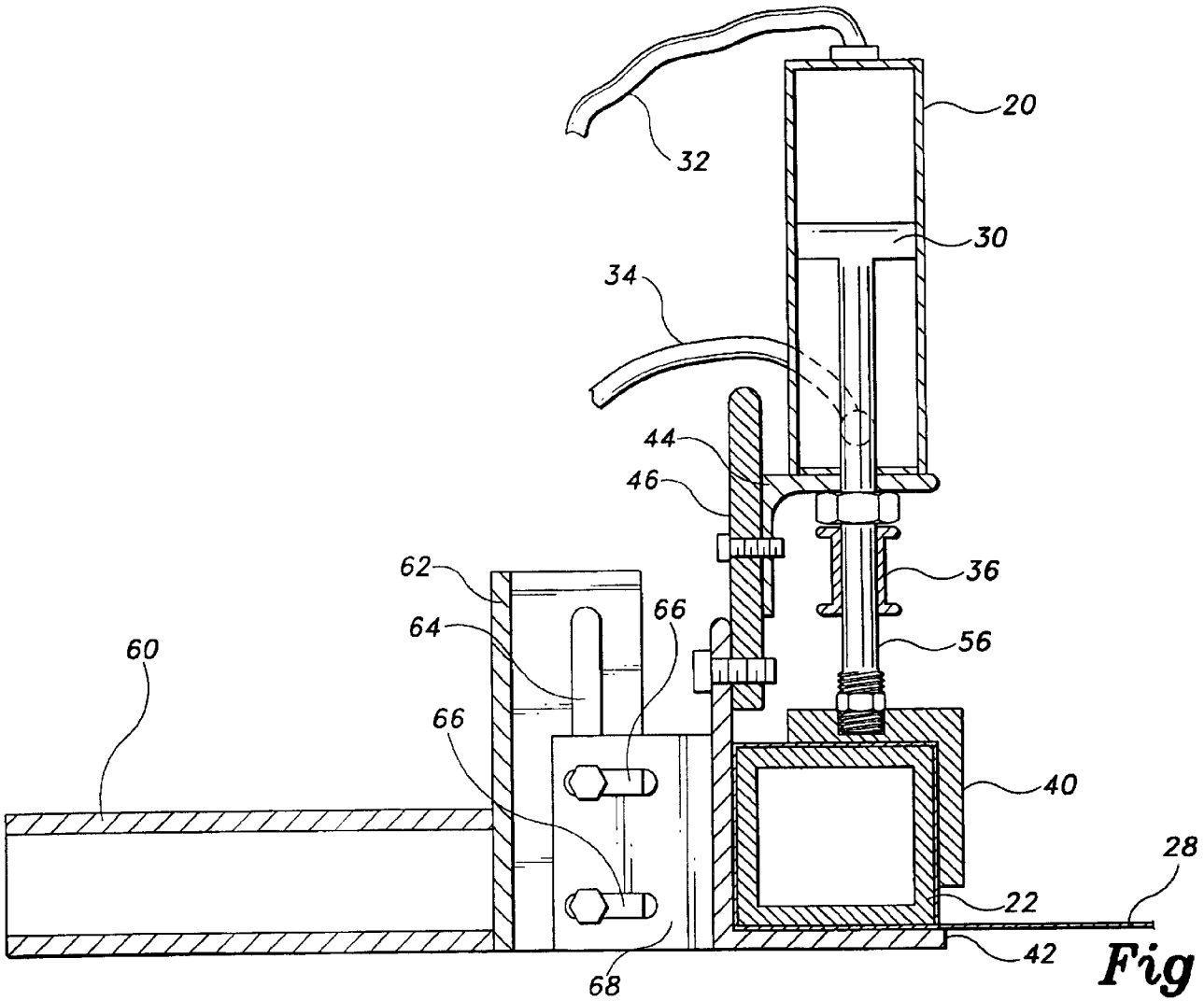
FIG. 2 is a detailed cross-sectional view of a screen frame clamped by a pneumatic cylinder in accordance with the present invention.

FIG. 2 shows one of the two pneumatic cylinders 20 having a piston 30 movable inside the cylinder 20. The piston 30 is connected to the movable portion 40 of the clamping device through a threaded piston rod 56. A bushing 36 acts to dampen the action of the movable clamp portion 40 when it travels upward. Preferably the pneumatic cylinder 20 has a cylindrical bore of 1.5 inches, a 2-inch stroke, and a maximum PSI of 1.7 times the line pressure, although the pneumatic cylinder 20 is not limited to these specifications. Any pneumatic cylinder that provides sufficient force to securely clamp the screen frame 22 to the head 50*a*, 50*b*, 50*c* or 50*d* is acceptable.

As shown in FIG. 2, a print screen frame 22 is held clamped in place by the pneumatic clamping device of the present invention. A print screen 28 is shown in the figure stretched beneath the underside of frame 22, the frame 22 being firmly clamped to the head 50*a*, 50*b*, 50*c* or 50*d* when the movable clamp portion 40 holds the frame 22 against the stationary clamp portion 42.

The movable clamp portion 40 is formed from lightweight aluminum stock approximately 0.250-inch thick and is designed to resist deflection due to torque applied to the surface of the movable clamp 40 by the pneumatic cylinders 20.

Each pneumatic cylinder 20 is adjustably mounted on its own support mount 44, which, in turn, is fastened by bolts to a support bracket 46 formed from 0.250-inch thick aluminum. The support bracket 46 is itself bolted, or otherwise suitably fastened, to the stationary clamp portion 42, which is formed from 0.125-inch thick steel bent upwards 90 degrees along its length. The stationary clamp portion 42 is fastened (e.g., by welding) to a slotted angle bracket 68. The two horizontal slots 66 in the slotted bracket 68 permit horizontal alignment of the printing screen frame 22 within print head 50*a*, 50*b*, 50*c* or 50*d*.

The slotted bracket 68 is fastened to an angle support bracket 62 by fasteners (e.g., bolts) passing through horizontal slots 66 in the slotted bracket 68 and vertical slot 64 in the angle bracket 62. The printing screen frame 22 can then be aligned vertically on the machine by adjusting the bracket 68 along the vertical slot 64. The angle support bracket 62 is permanently fastened, such as by welding, to the tubular support 60, which is slidably received by head support cross member 58, which is itself welded to head support arm 26.

Figure 3:
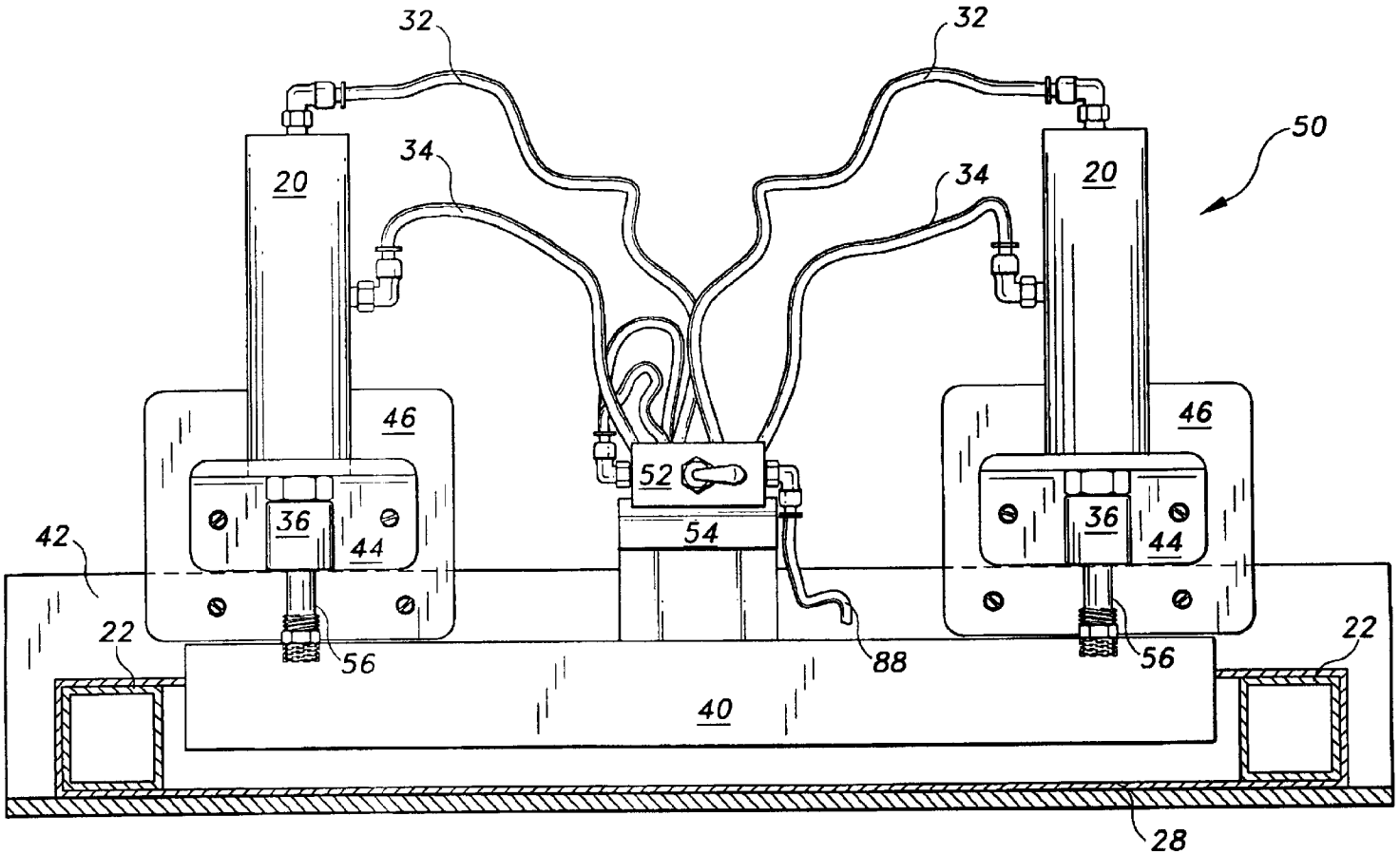
FIG. 3 is a front view of a dual cylinder screen head according to the present invention.

FIG. 3 shows the tandem pneumatic cylinders 20 for one of the heads 50 with the movable clamp portion 40 in the "clamp open" position. Two pneumatic cylinders 20 are mounted on their respective mounting brackets 44. Each of the mounting brackets 44 is then fastened to its respective support bracket 46. The ends of the piston rods 56 of both cylinders are fastened (e.g., by a threaded connection) at separate points along the movable clamp portion 40. Adjustments are made as necessary to ensure that the movable clamp portion 40 remains horizontally level with respect to the printing screen frame 22 to ensure accurate alignment when using the apparatus 10 and to ensure simultaneous operation of the cylinders 20.

A 2-position, 4-way, normally closed/normally open, detented valve 52 with single-direction throw, the throw having a pinned lever, and with all ports except the exhaust ports having ⅛" NPT threads, is mounted on its own support bracket 54. The valve 52 is manually actuated by the lever to simultaneous operate cylinders 20, causing the movable clamp portion 40 to securely clamp the edge of frame 22. As disclosed, valve 52 has one air input port, two output ports, and a manual lever, the position of the lever determinative of which of the two output ports is connected to the air supply. Furthermore, valve 52 has integrated exhaust valves, (not shown), which bleed off excess air, allowing smooth motion of the movable clamp portion 40 and guarantee a controlled transition from a "clamp open" position to a "clamp closed" position and vice versa.

Figure 4:
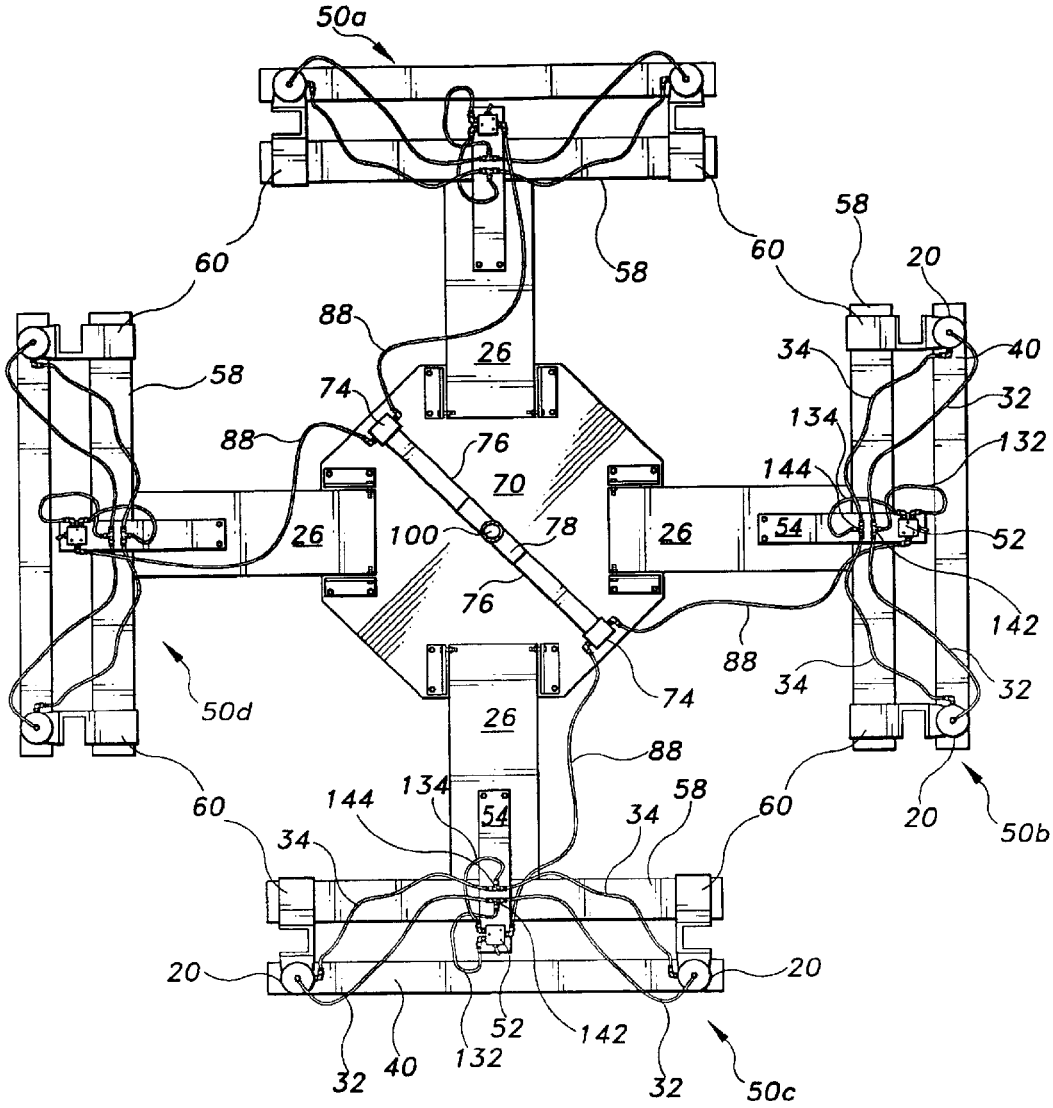
FIG. 4 is a plan view of the pneumatic distribution system for a four-head screen-printing apparatus according to the present invention.

As shown in FIG. 4, the air distributed to each of the pneumatic cylinders 20 passes through a main supply line 100 into a main distributor 78 that is mounted on the carousel 70. The air then flows outwardly and horizontally through two arms 76 to the two T-connections 74 at the ends of each arm 76 and into the valve air supply inlet lines 88 for each head.

The inlet lines 88 supply air to the inlet port of valve 52 and, depending upon whether the air is directed to the upper portion of cylinder 20, to clamp the frame 22, or to the bottom portion of the cylinder 20 to release the clamp, the air flow exits the first or second valve port and is distributed by lines 134 and 132 to a pair of manifolds, e.g. T-connections, 142 and 144, respectively, to provide simultaneous operation of pneumatic cylinders 20.

Thus, when valve 52 is set to the "clamp open" position, i.e., when releasing the print screen from the clamp, air flows through lines 34 to cause the tandem pistons to move the movable clamp portion 40 upwards, away from the stationary clamp portion 42. Conversely, to clamp a screen frame 22 in place in a head 50, the valve 52 is moved to the "clamp closed" position allowing air to flow through lines 32 causing the tandem pistons 56 to extend the movable clamp portion 40 downward cooperatively engaging one edge of frame 22. Once clamped in place, the print screen can then be used for printing indicia onto a textile workpiece by moving the screen 28 downward onto the textile workpiece through the respective head support arm 26.

Figure 5:
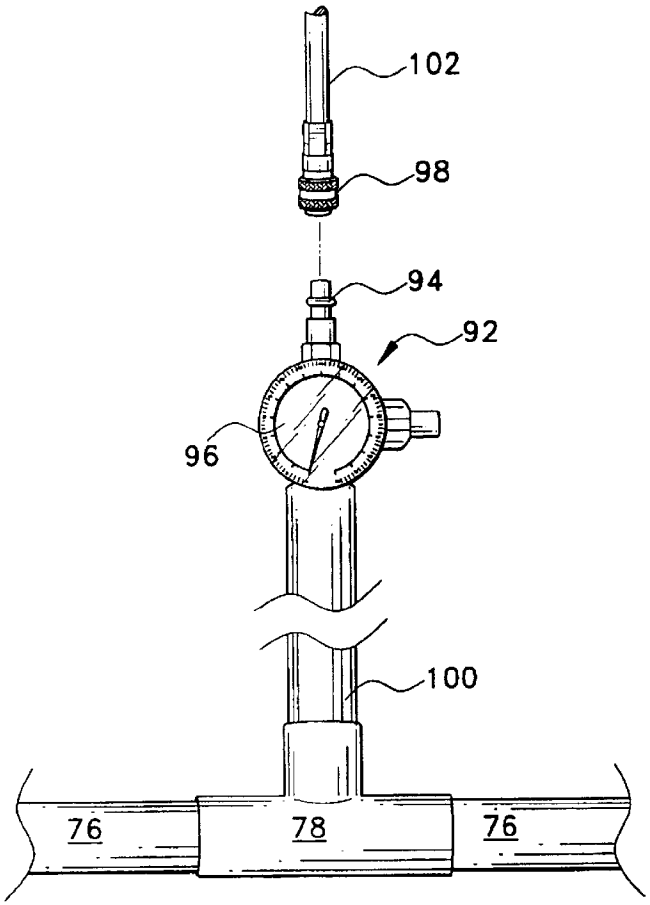
FIG. 5 is a fragmented elevation view of a portion of the pneumatic supply system according to the present invention.

FIG. 5 is a view of the main air distribution showing the compressor supply line 102 above the machine and having a quick disconnect connector 98, which receives male connector stem 94. Connector 94 has a stationary part and a 360 capable rotation part, permitting air to be continuously supplied into the vertical supply line 100 of the screen-printing apparatus 10 without applying rotational torque on connector 94 or on supply line 102 when carousel 70 is rotated. An air pressure regulator 92, having a pressure gauge 96, is used to adjust air pressure in the screen-printing apparatus. Although pressurized air at 60 psi is used in the preferred embodiment, air at any pressure within the operating range of pneumatic cylinders 20 is contemplated herein, as well as from any source which may include an air compressor, a tank of compressed air, or other supply of pressurized air.

Although the present embodiment discloses pneumatic cylinders 20 operating to clamp a screen frame 22 to each head 50 of a four-head manually operated screen-printing apparatus, the apparatus is also contemplated for use in any manually operated screen-printing apparatus that requires the ability to quickly and easily replace different printing screens in the screen holding heads of these machines, whether the apparatus has one, two or any number of heads.

It is further noted that the valve mounting bracket 54 has a generally S-shaped cross-section (not shown) so as to ensure that valve 52 extends a short distance away from the clamping portion of the head, thereby preventing an operator from inadvertently trapping their fingers or hand in the clamp when actuating the pair of pneumatic cylinders 20.

It is to be understood that the present invention is not limited to the embodiments described above, but encompasses any and all embodiments within the scope of the following claims.

I claim:

1. A screen-printing apparatus, comprising:

a platen for supporting a workpiece; and at least one print head having a frame clamp removably mounted to the at least one print head, a print screen frame removably attached to the frame clamp, the frame clamp having a reciprocating clamp portion and a stationary clamp portion, the reciprocating clamp portion and the stationary clamp portion cooperatively engaging the frame;

at least one pneumatic cylinder mounted to the stationary clamp portion, the cylinder having a piston and a piston rod, the piston rod having two opposing ends, one end of the piston rod being connected to the piston, the opposite end of the piston rod being connected to the reciprocating clamp portion, the piston and connected piston rod being movable inside the cylinder, the piston defining two chambers inside the cylinder;

adjusting means for horizontally and vertically aligning the frame clamp on the print head;

a two position valve having an inlet port, a first outlet port, a second outlet port, and a single direction throw with pinned lever;

an air distribution system connecting the first and second outlet ports of the valve to the first and second chambers, respectively of the at least one pneumatic cylinder; and a main air supply system for distributing air to the valve, the main air supply adapted for receiving a supply of pressurized air from a source in an amount sufficient to activate the at least one pneumatic cylinder;

whereby the piston rod is operative to cooperatively engage the frame between the reciprocating portion of the clamp and the stationary portion of the clamp, thereby securing the frame to the print head.

2. The screen-printing apparatus according to claim 1, wherein the air distribution system further comprises a first and second air manifold, each manifold having an inlet and at least two outlets, the inlet of the first air manifold being connected to the first air outlet of said valve, and the inlet of the second air manifold being connected to the second air outlet of said valve, the outlets of the first air manifold being connected to the first chamber of the at least one pneumatic cylinder, and the outlets of the second air manifold being connected to the second chamber of the at least one pneumatic cylinder.

3. The screen-printing apparatus according to claim 1, wherein said main air supply system further comprises a pressure gauge and a stem extending therefrom, the stem having a stationary part and a part rotatable about the stationary part, the rotating part adapted for being received by an air hose.

4. The screen-printing apparatus according to claim 1, wherein said at least one print head comprises four print heads.

5. The screen-printing apparatus according to claim 1, wherein said reciprocating clamp portion is made of aluminum.

6. The screen-printing apparatus according to claim 1, wherein said at least one pneumatic cylinder is adjustably mounted to said print head.

7. The screen-printing apparatus according to claim 1, wherein said at least one cylinder comprises two pneumatic cylinders operating in parallel, whereby the piston rod of each cylinder is connected to the moveable clamp portion of said clamp.

8. The screen-printing apparatus according to claim 7, wherein said valve is mounted above said clamps and between said pneumatic cylinders.

* * * * *